United States Patent [19]

Buckley et al.

[11] Patent Number: 4,746,890

[45] Date of Patent: May 24, 1988

[54] MOUNTING FOR IGNITION MODULE

[75] Inventors: Francis P. Buckley, Springfield; Antonio Gomes, Jr., East Longmeadow, both of Mass.

[73] Assignee: R. E. Phelon Company, Inc., East Longmeadow, Mass.

[21] Appl. No.: 123,560

[22] Filed: Nov. 20, 1987

[51] Int. Cl.[4] ..... H01F 27/30

[52] U.S. Cl. ..... 336/197; 29/606

[58] Field of Search ..... 29/606, 602 R; 310/214, 310/43, 42, 168, 169, 170; 336/197, 196, 96, 205

[56] References Cited

U.S. PATENT DOCUMENTS 2,266,618 12/1941 Stimson ..... 336/197 X

*Primary Examiner*—Thomas J. Kozma

*Attorney, Agent, or Firm*—Chapin, Neal & Dempsey

[57] ABSTRACT

Mounting for ignition module in which a ferromagnetic flux carrying core includes a plurality of spaced, parallel leg portions. The ignition coil module has a generally central opening which is adapted to receive one of the core legs. A tapered slot is formed on one side of said coil module and is adapted to receive a correspondingly tapered bar portion of a synthetic plastic retainer. The retainer is an integral, thermoplastic block with a channel on the side opposite the tapered bar portion adapted to slide-fit about the inner edge portion of the core leg. A recess is provided in the leg of the core opposite the slot on said module. The retainer includes a frangible lug portion which is adapted to be displaced against the portion of the leg in which the recess is formed. Whereupon, when the lug is softened by ultrasonic energy, it flows into the recess and hardens therein while bonding to the contiguous portions of the retainer to fasten the module in fixed assembled relation on the core.

5 Claims, 2 Drawing Sheets

MOUNTING FOR IGNITION MODULE

BACKGROUND OF THE INVENTION

Various methods and means have been used in the past for fastening a coil module onto a leg portion of a flux carrying armature or core.

In one such method, the coil module is bonded onto the core leg by using an epoxy resin bonding agent. The major drawback of this technique is that it does not lend itself to automated processing and the application of the epoxy for effective bonding is time consuming.

Other methods have involved the use of metallic mounting clips especially adapted to be affixed to the core at their inner ends and with an angle or bend at their outer ends to capture and hold the module in fixed position on the core leg. Among the drawbacks of using these metal clips, is that they tend to absorb some of the electromagnetic energy generated in the coil and reduce the kilovolt output of the ignition coil. Moreover, such clips must be fastened to the core and to the module and thus they are not readily adaptable to automated assembly techniques.

More recently, U.S. Pat. No. 4,568,903, issued to the same assignee as the instant application, discloses a resiliently flexible synthetic plastic retaining pin. The drawback of this type of retaining pin 14 is that the metal core lamination 10 tends to shave-off one side of the retaining pin as it is driven into the recess 22 whereby its holding power, achieved by compress of the pin, is substantially diminished.

The principal object of this invention is to provide an improved and highly effective means for fastening a coil module to a flux carrying core which overcomes the drawbacks of the prior art.

Another object of this invention is to provide means for fastening a coil module to a flux core which is adaptable to automated assembly techniques.

A further object of this invention is to provide a fastener of the above type which also acts to dampen vibrations in the core portion on which the module is mounted.

The above and other objects or advantages of this invention will be more readily appreciated from the following description read in conjunction with the accompanying drawings in which.

Figure 1:
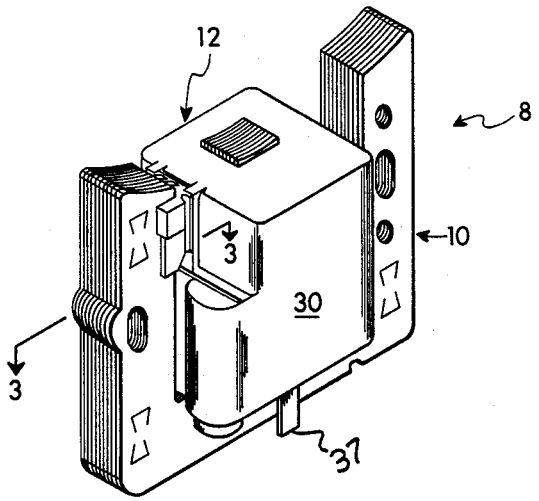
FIG. 1 is a perspective view of a coil/core assembly of the type used in magneto ignition systems.

Referring in detail to the drawings, in FIG. 1 an ignition coil/core assembly is shown generally at 8. The assembly comprises an E-shaped, multi-leg core 10 and an ignition coil module 12 mounted on the core.

Figure 2:
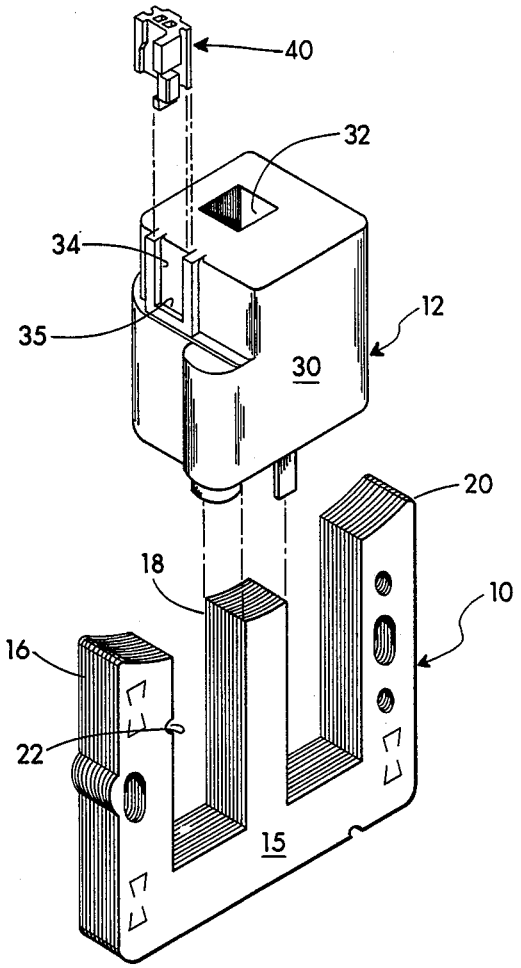
FIG. 2 is an exploded view of the elements of the coil/core assembly.

The core 10, also shown in FIG. 2, comprises a laminated structure of sheet metal plates fastened together, such as by cleating or other suitable methods. The core includes a cross-bar portion 15 and three parallel leg portions 16, 18 and 20 extending outwardly therefrom. The terminal ends of the legs are radiused since the core provides a flux path for magnet poles rotated in a circular path about the ends of the core legs in the conventional manner. At a point adjacent the outer end of leg 16, a semi-circular cutout or recess 22 is provided which will serve in the assembly, as will hereinafter be more fully described.

The module 12 comprises a synthetic plastic shell 30 of generally rectangular configuration. The shell is generally a premolded polypropylene material into which is fitted in the primary and secondary windings of an ignition coil. Also, an electronic control circuit may be fitted into the shell which is then filled with a dielectric potting compound. An opening or chimney 32 extends axially through approximately the central portion of the coil module. This opening is generally rectangular in cross-section and is dimensioned to be slightly larger than the cross-section of the core leg 18 to provide sufficient clearance for ease of assembly. On one side of the module, a tapered slot or channel 34 is provided. The channel is open at its lower end and closed at its upper end, as indicated at 35. The width of the channel tapers inwardly from its lower to its upper end and is adapted to receive, in snugly fitting relation therein, a correspondingly tapered bar portion 36 (FIGS. 3 and 4) of retainer clip 40. A ground terminal 37 extends from the module and may be welded to the surface of cross-bar portion 15 of the core core 10.

When the inner surface of the module 12 is disposed in contact with the cross-bar 15 of the core, the recess 22 and tapered channel 34 are disposed in spaced, opposed relation and the retainer clip 40 may then be fitted between the module channel 34 and the core leg 16 to hold the two parts in their assembled relation for final processing, as will hereafter be more fully described.

The clip 40 is a resilient member of generally rectangular block of molded synthetic plastic material. The block includes a pair of holes 42 and 43 which extend therethrough to reduce the amount of material used to form the block and to increase the compressability of the block. The clip comprises a raised bar portion 36 disposed along one side surface of the block. At one end, the bar extends outwardly of the block. The bar 36 is tapered inwardly toward its free end and corresponds to the taper of the channel 34 formed on one side of module 12.

Figure 6:
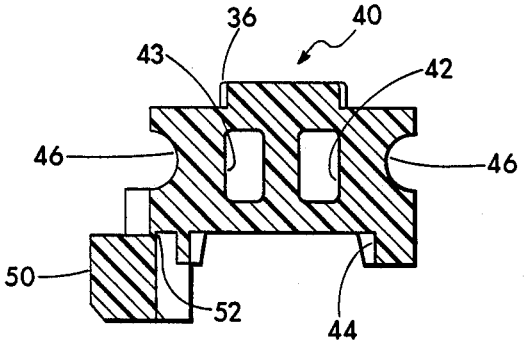
FIG. 6 is a sectional view taken along line 6—6 of FIG. 3.

The side of clip 40 opposite the bar 36 is provided with a channel or recess 44 adapted to slide-fit snugly about the inner portion of core leg 16 at the same time that the bar 36 is being fitted into the tapered channel 34. The two other sides of the block include semi-cylindrical cavities 46 (FIG. 6) adapted to receive the arms of the fixtures (not shown) which handles and feeds the clip in an automated assembly technique.

Figure 3:
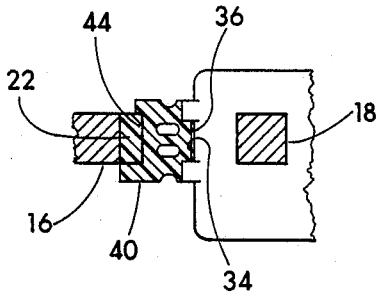
FIG. 3 is a sectional view taken along line 3—3 of FIG. 1.
Figure 4:
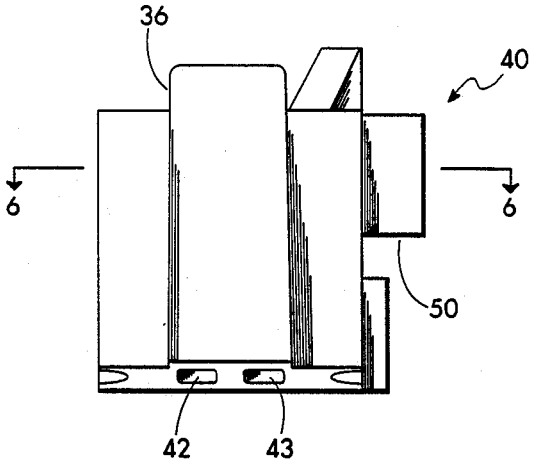
FIG. 4 is a top, plan view of a retainer clip embodying this invention.
Figure 5:
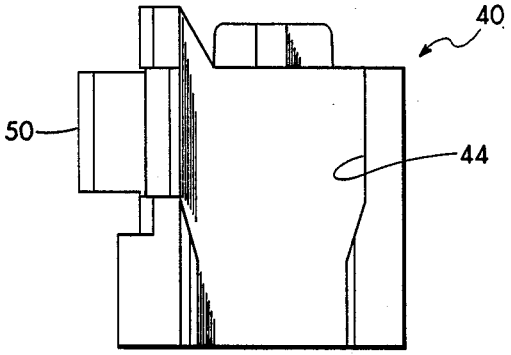
FIG. 5 is a bottom plan view of the retainer clip.

On one side of the clip 40, is an upstanding block or lug 50 which is integral therewith and connected to the clip by relatively thin web or membrane portions 52 (FIG. 6) of the plastic material which makes up the clip. These web portions are readily frangible so that the lug 50 can be readily broken from the clip and displaced inwardly against the leg 16 of the core in registered relation with the recess 22. In the assembly process, this step is carried out by an ultrasonic horn or tool (not shown) which is then immediately energized with ultrasonic energy sufficient to soften or melt the plastic lug 50 and the surrounding contiguous areas of the retainer. As this occurs, the plastic of the lug 50 will flow into the recess 22, as shown in FIG. 3, when the ultrasonic energy is turned "off", the plastic comprising the lug will set, harden and rebond or fuse to the clip 40. As a result, a positive interlock will be provided by the retainer clip between the module 12 and the metallic core 10. The entire cycle time for each unit is approximately 2.5 seconds, and lends itself to reliable, rapid and economical automated processing.

The retainer 40 is preferably molded of a thermoplastic, such as polyamide containing glass fiber reinforcement on the order of about 30% by weight to the resulting composite material.

This invention first provides for the rapid and easy temporary assembly of a metallic, laminated core and coil module and then the permanent interlock of the components in assembled relation.

The retainer 40 also serves another important function, in that its block-like construction is firmly wedged between the module 30 and the core leg 16. This arrangement reinforces or stabilizes the center leg 18 onto which the module is snugly fitted whereby vibrations caused by the engine in the center leg are sufficiently dampened to prevent fatigue of the welded terminal 37 and of the laminations forming the center leg 18 of the core.

It will be apparent to those skilled in the art that variations may be made in the retainer clip 40 without departing from the broader aspects of this invention.

Having thus described this invention, what is claimed is:

1. In a coil/core assembly having a flux carrying core with a cross-bar portion and at least two laterally spaced, generally parallel leg portions and with a coil module disposed on one of said leg portions, the improvement comprising a thermoplastic retainer fitted between said module and the opposed inner portion of one of said core legs in which is provided a recess, said module also being provided with means to receive and hold a portion of said retainer, said retainer including a lug portion adapted to flow into said recess in response to ultrasonic energy applied thereto and when set therein, serves to fasten said coil/core assembly in assembled relation.

2. In a coil/core assembly, as set forth in claim 1, in which said module includes a tapered channel to receive a correspondingly tapered bar portion of the plastic retainer, said retainer comprising a generally rectangular block of thermoplastic material.

3. In a coil/core assembly, as set forth in claim 2, in which said retainer is a block of a composite material including a polyamide resin and glass fibers dispersed therein, said block including a raised bar disposed on one face of the block, said bar being tapered from one end to the other to correspond to the taper of said channel.

4. In a coil/core assembly, as set forth in claim 3, in which said lug portion is frangibly disposed on the retainer block for ready displacement therefrom and onto the portion of said leg in which said recess is provided, the thermoplastic forming said lug being adapted to flow into said recess and, when the fluent material hardens therein and refuses to the retainer block, it fastens the coil and core in permanent assembled relation and dampens engine vibrations in the one leg portion of the core on which the module is disposed.

5. Method of assembling a coil module on a ferromagnetic core for an engine ignition system in which the core includes a cross-bar portion and at least two laterally spaced leg portions and a coil module with a hole adaptable to fit onto one of the leg portions of the core, said method comprising the steps of providing a recess on a portion of the core adjacent the core leg adapted to receive the coil thereon and means disposed on the module opposite said recess for receiving and retaining a plastic retainer clip, said clip comprising a thermoplastic block which includes means for snug, slide-fitting engagement on the leg containing the recess and the retaining means on said module, said block including a frangibly mounted lug portion adapted to register with said recess, applying an ultrasonic horn to said lug to break away and displace said lug into juxtaposition with said recess, applying, by said horn, ultrasonic energy to the displaced lug to cause the thermoplastic lug to flow into said recess, and thereupon cutting-off said energy to allow such thermoplastic to set within the recess and to refuse to contiguous portions of said block whereby the module and core are permanently fastened in assembled relation.

* * * * *